United States Patent [19]

Belenson

[11] 4,210,186

[45] Jul. 1, 1980

[54] CAMERA BAG

[76] Inventor: Mark I. Belenson, 4799 E. Tenth La., Hialeah, Fla. 33013

[21] Appl. No.: 62,994

[22] Filed: Aug. 2, 1979

[51] Int. Cl.[2] ..... A45C 11/38

[52] U.S. Cl. ..... 150/52 J; 150/34; 190/52

[58] Field of Search ..... 150/52 J, 34; 190/52, 190/51, 42, 48; 206/578, 593

[56] References Cited

U.S. PATENT DOCUMENTS

| | | | |
|---|---|---|---|
| 1,510,815 | 10/1924 | Adams | 190/51 |
| 2,911,024 | 11/1959 | Miceli | 190/51 X |
| 3,128,854 | 4/1964 | Specht | 190/51 X |
| 3,381,782 | 5/1968 | Ikelheimer | 190/51 |
| 3,587,795 | 6/1971 | Berry | 190/52 X |
| 3,759,356 | 9/1973 | Bostick | 190/42 |
| 4,093,010 | 6/1978 | Hunley | 150/52 J |

FOREIGN PATENT DOCUMENTS

| | | | |
|---|---|---|---|
| 6811304 | 2/1970 | Netherlands | 190/51 |

*Primary Examiner*—Donald F. Norton
*Attorney, Agent, or Firm*—Ernest H. Schmidt

[57] ABSTRACT

A flexible fabric camera bag having a central main bag portion and a pair of relatively short end bag portions is provided with a removable camera bag compartment insert for the main bag portion for protectively storing and carrying fragile cameras and photographic accessories. The insert is fabricated of flexible, padded, side and bottom walls, and is partitioned with displaceable divider walls to adapt to the sizes of particular articles to be carried, while at the same time permitting flexure of the camera bag assemblage to comply with the shape of the body portion against which the camera bag rests while being carried as a shoulder bag.

8 Claims, 5 Drawing Figures

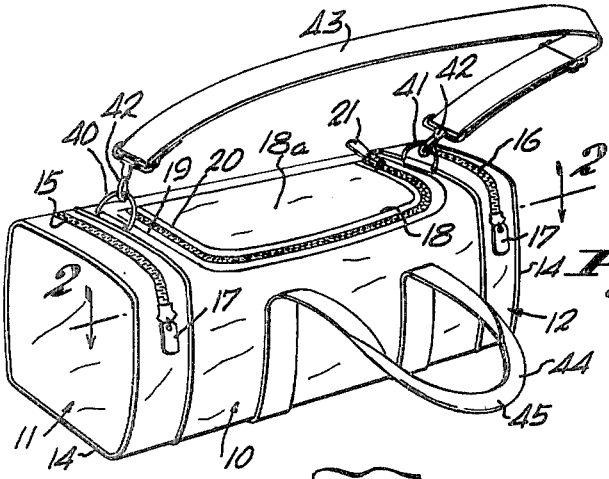
Fig. 1
Fig. 2
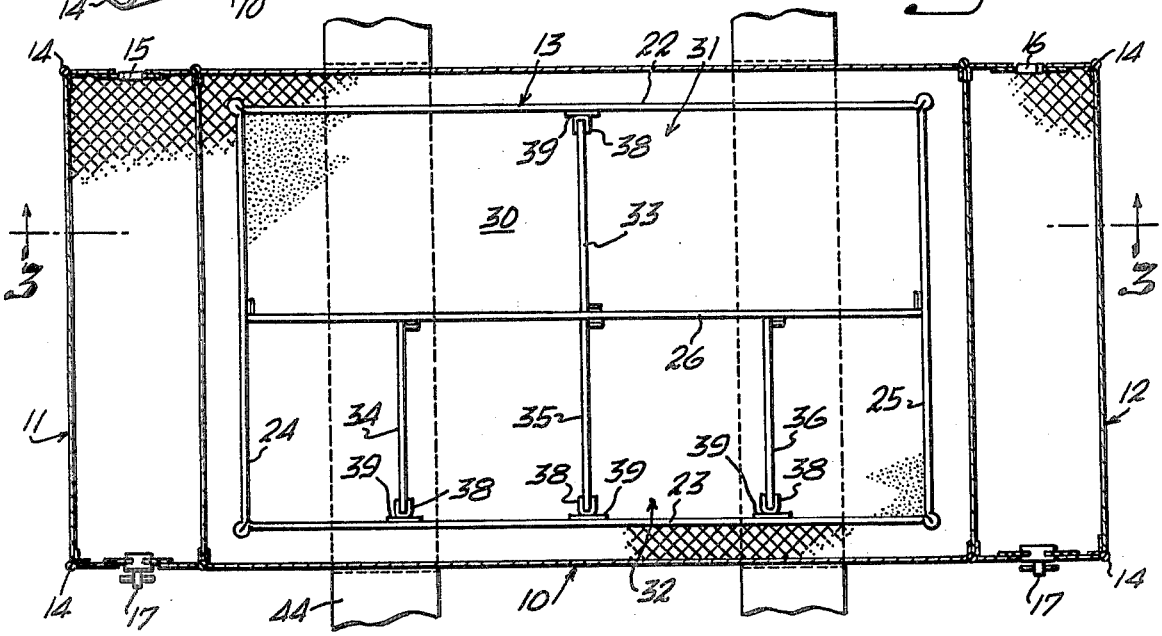
Fig. 3
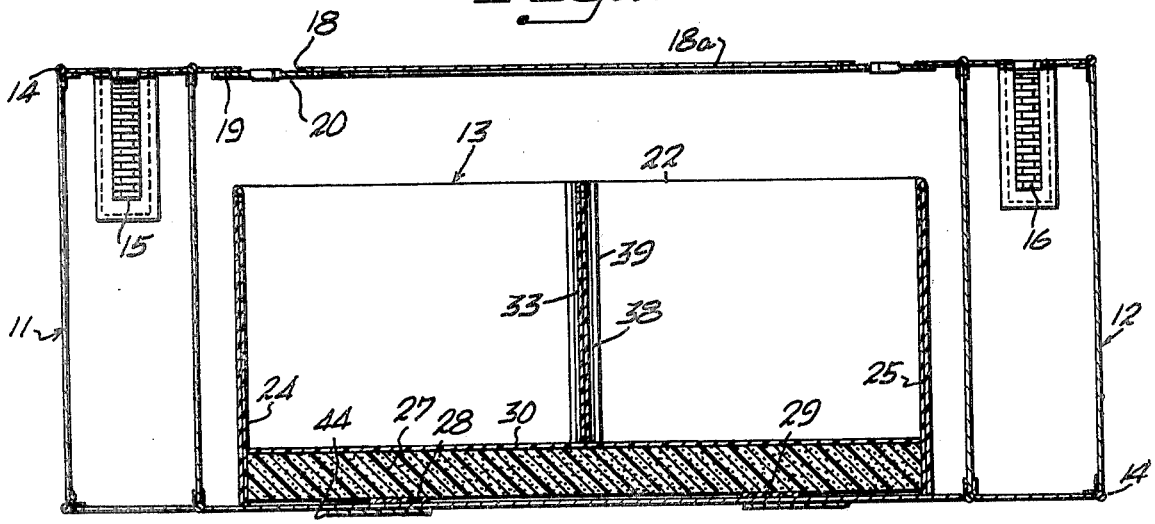

CAMERA BAG

This invention relates to carrying cases for fragile articles such as photographic cameras, camera lenses and the like, and is directed particularly to a novel and improved general purpose camera bag that in addition to providing protection against shock damage to the articles being carried, is very light in weight and flexible in its assemblage to provide for ease in carrying, particularly when being carried as a shoulder support bag.

Various photographic accessories or so-called camera and gadget bags have heretofore been devised for safely carrying and storing fragile and expensive cameras and other photographic paraphernalia. Such camera bags or cases heretofore devised, however, relied for the most part upon rigidity of the bag or casing structure in affording protection to the contents, and were therefore constructed of leather, wood, synthetic plastic, metal or other substantially rigid or stiff materials, with padded compartments or the like provided inside for placement of the articles to be carried. Such camera bags, while offering good protection for the storage and carrying of the photographic articles, were necessarily heavy and not well adapted to casual carrying.

It is, accordingly, the principal object of this invention to provide a novel and improved camera bag that, while offering excellent protection for the photographic articles being carried, is at the same time very light in weight and well adapted to casual carrying, either as a hand bag or as a shoulder bag.

A more particular object of the invention is to provide a camera bag of the character described the outer casing of which is fabricated of a tough, flexible textile material to provide an elongated central bag portion, against the ends of which are sewn comparatively short end bag portions, the central bag portion being provided with a removable, compartmented insert having padded flexible side and bottom walls affording protection for the articles to be stored and carried while at the same time allowing for flexibility of the entire carrying bag assemblage for ease and comfort in casual carrying.

Another object of the invention is to provide a camera bag of the character described the size, shape and flexibility of which is such that when carried with a shoulder strap as a shoulder bag conforms comfortably to the torso shape of the person carrying the bag.

Yet another object of the invention is to provide a camera bag of the above nature wherein certain of the dividing walls of the compartmented camera bag insert are selectively displaceable to provide for adjustment of compartment size accommodating to the various sizes of the fragile photographic articles to be carried.

Yet another object of the invention is a novel and improved camera bag which will be simple in construction, attractive in appearance, dependable in its protective performance and durable in use.

Other objects, features and advantages of the invention will be apparent from the following description when read with reference to the accompanying drawings. In the drawings, wherein like reference numerals denote corresponding parts throughout the several views:

FIG. 1 is an oblique view of a camera bag embodying the invention as seen from above;

FIG. 2 is a horizontal cross-sectional view of the bag taken along the plane indicated at 2—2 of FIG. 1 in the direction of the arrows;

FIG. 3 is a vertical cross-sectional view taken along the line 3—3 of FIG. 2 in the direction of the arrows;

Figure 4:
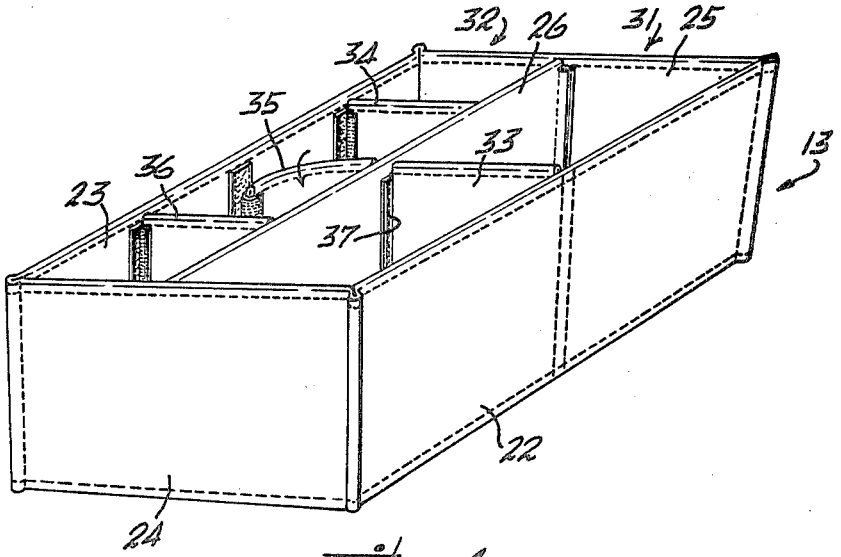
FIG. 4 is an oblique view of the camera bag compartment insert, shown separately as viewed from above.
Figure 5:
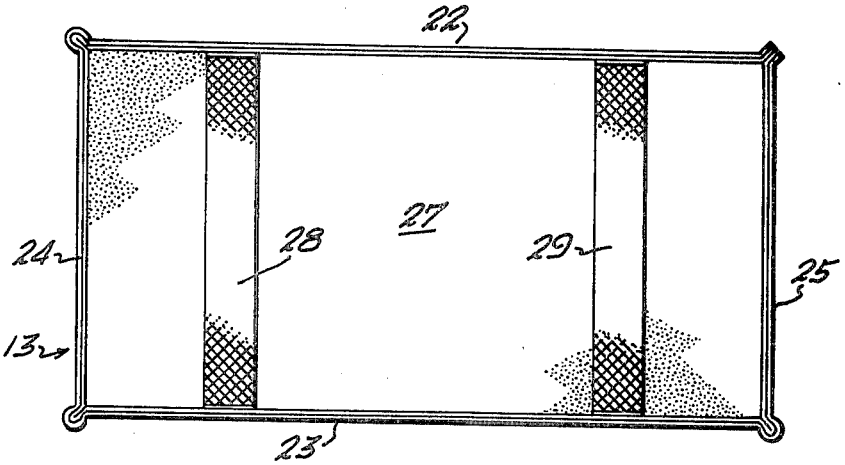
FIG. 5 is a bottom view of the camera bag compartment insert shown in FIG. 4.

As best illustrated in FIG. 1 the camera bag comprises an elongated, central, main bag portion 10 and a pair of relatively short end bag portions 11, 12 and a removable camera bag compartment insert 13 removably receivable within said main bag portion. The main and end bag portions 10, 11, and 12 are of generally rectangular cross-sectional shape, with rounded corners and are preferably fabricated of a tough, pliable fabric such as canvas or woven synthetic fiber such as "Nylon" for example, a trademark registered product of DuPont Corporation. Peripheral junctures and ends of the end bag portions 11, 12 are sewn with piping 14. The end bag portions of pockets 11, 12 are provided, at central portions along the top, with zippers 15, 16 respectively, providing for their opening and closure with the use of zipper slides 17. The main bag portion 10 is cut into a U-shaped slot 18 along the top, thereby defining a bag opening flap **18*a* which, when withdrawn, provides a top access opening. The opposed edges of the slot 18 have sewn thereagainst cooperative zipper strips 19, 20 having a zipper pull tab 21** permitting opening and closing of the rectangular bag access opening.

Removable camera bag insert 13 is rectangular in shape, and comprises side walls 22, 23, end walls 24, 25 and central, end-to-end partition wall 26, all of which walls being of a soft, resilient material with sufficient rigidity to maintain the rectangular shape when unstressed. Preferably this material will be a fabrication of two face-to-face panels of synthetic plastic material, each with a densely foamed central lamina, the assembly affording soft padding for articles stored within the camera bag insert 13 in the manner hereinafter appearing.

The camera bag insert 13 is also provided with a comparatively thick, resilient bottom wall 27 which is removably seated in place against a pair of fabric strips 28, and 29 extending between lower edge portions of compartment member side walls 22, 23, in spaced relation therealong. The rectangular bottom wall 27 will preferably be a foamed synthetic plastic material such as foamed polyurathene, and has fixed against its upper surface, as by a suitable adhesive, a facing layer of self synthetic plastic material 30, preferably a single panel of the same material used in the fabrication of the side and end walls of the camera bag insert 13, as described above.

As illustrated in FIGS. 3 and 4, camera bag insert 13 is divided into longitudinally-extendng compartments 31, 32 by central, end-to-end, partition wall 26. Longitudinal compartment 31 is sub-divided into two sub-compartments by a central transverse divider wall 33, whereas longitudinal compartment 32 is divided into four sub-compartments by transverse interior partition wall members for divider walls 34, 35, and 36 equally spaced therealong. Each of the transverse divider walls 33 through 36 has its inner end sewn to longitudinal partition wall 26, as indicated at 37. The outer ends of transverse divider walls 33 through 36 each has sewn therealong Velcro hook strips 38 adapted to be removably attached to associated Velcro fleece strips 39 sewn against opposite portions at the insides of side walls 22 and 23 of camera bag compartment insert 13. Thus, as best illustrated by the central transverse interior partition wall members or divider wall 35 in FIG. 4, one or more of the transverse divider walls can be released from its outer end Velcro connection and folded back for increasing sub-compartment size, or for complete removal of sub-compartmentation in accordance with size requirement etc. of articles to be carried. In this connection, it is to be noted with reference to FIG. 3 that the bottom edges of partition wall 26 and transverse divider walls 33 through 36 extend short of the side and end walls of camera bag insert 13 by the thickness of bottom wall 27, so that said bottom wall will be retained in place therebetween and the fabric strips 28, 29.

As illustrated in FIG. 1, hook eyes 40, 41 are sewn to the top of the camera bag, at central portions along the junctures of end bag portions 11, 12 and central main bag portions 10, for interconnection therewith of the hook ends 42 of adjustable shoulder strap 43. For hand carrying, a continuous length of fabric strap 44 is sewn around the sides and underside of central main bag portion 10 to terminate in upwardly-extending, opposed loops 45 (only one illustrated in FIG. 1) which can be placed together above the top of the bag for convenient carrying by hand.

An important feature of the camera bag resides in the flexibility, adjustability and resiliency of the camera bag compartment insert whereby fragile photographic cameras, lenses, light meters, flash lamps and the like paraphernalia may be safely carried. The resiliency of the camera bag assemblage, moreover, lends itself to flexing to accommodate to the shape of the torso when carrying by the shoulder strap, for example. As described above, flexible divider walls 33 through 36 will be adjusted for accommodation to size of the articles being carried. The compartment bottom wall 27 is especially resilient to protect against the shock of inadvertent dropping of the bag, while at the same time being loosely enough joined with respect to the side and end walls of the camera bag compartment insert to provide for the above described flexibility and resilience in the camera bag assemblage.

Another advantage is that upon removal of the camera bag compartment insert, the bag can serve independently as a traveling hand bag or overnight bag for carrying clothing or other luggage.

While I have illustrated and described herein only one form in which my invention can conveniently be embodied in practice, it is to be understood that this form is presented by way of example only and not in a limiting sense. My invention, in brief, comprises all the embodiments and modifications coming within the scope and spirit of the following claims.

What I claim as new and desire to secure by Letters Patent is:

1. A camera bag comprising, in combination, a main bag portion of flexible material, said main bag portion having upper end opening means, a substantially rectangular camera bag insert member removably receivable within the said main bag portion through said upper end opening means, said bag insert member comprising peripheral side walls and end walls all of which walls are fabricated of a soft, pliable and flexible material serving as padding for contained articles, a plurality of interior partition wall members sub-dividing said bag insert member into a plurality of insert compartments, said partition walls also being fabricated of a soft, pliable and flexible material serving as padding for contained articles, a comparatively thick, resilient bottom wall member, means for removably securing said bottom wall member at the lower end of said bag insert member, carrying strap means attached to said main bag portion for carrying the camera bag, said main bag portion, said bag insert member and said interior partition wall members being of such flexibility and resilience as to permit flexure of the camera bag assemblage to comply with the shape of the body portion against which the camera bag rests while being carried.

2. A camera bag as defined in claim 1 wherein one or more of said interior partition wall members are releasably attached to inside zones of said bag insert member peripheral side walls to provide for changing sizes of said sub-divided insert compartments.

3. A camera bag as defined in claim 2 wherein the releasable attachment means for said sub-plurality of interior partition wall members is pressure sensitive.

4. A camera bag as defined in claim 2 wherein said main bag portion upper end opening means comprises a U-shaped zipper run defining a substantially rectangular opening flap.

5. A camera bag as defined in claim 4 wherein said means for removably securing said bottom wall member comprises a pair of flexible straps extending in mutually spaced relation and transversely between lower edge portions of said peripheral side walls, said plurality of interior partition wall members extending short of the lower ends of said bag insert member peripheral side walls and end walls by a distance approximately equal to the thickness of said bottom wall member, said bottom wall member being constrained between the lower edge portions of said partition wall members and said transverse straps.

6. A camera bag as defined in claim 5 wherein one or more of said interior partition wall members are releasably attached to inside zones of said bag insert member peripheral side walls to provide for changing sizes of said sub-divided insert compartments.

7. A camera bag as defined in claim 1 wherein said means for removably securing said bottom wall member comprises a pair of flexible straps extending in mutually spaced relation and transversely between lower edge portions of said peripheral side walls, said plurality of interior partition wall members extending short of the lower ends of said bag insert member peripheral side walls and end walls by a distance approximately equal to the thickness of said bottom wall member, said bottom wall member being constrained between the lower edge portions of said partition wall members and said transverse straps.

8. A camera bag as defined in claim 1 including a pair of relatively short end bag portions of flexible material secured one each against the ends of said main bag portion, said end bag portions each being provided with a zippered access opening at the top thereof.

* * * * *